US005195481A

United States Patent [19]

Oyama et al.

[11] Patent Number: 5,195,481

[45] Date of Patent: Mar. 23, 1993

[54] TWO-CYCLE ENGINE WITH SEPARATE LUBRICATING SYSTEM

[75] Inventors: Yoshihito Oyama; Kenji Ikeda; Masami Ohara, all of Hamamatsu, Japan

[73] Assignee: Sanshin Kogyo, KK, Japan

[21] Appl. No.: 796,395

[22] Filed: Nov. 22, 1991

[30] Foreign Application Priority Data

Nov. 22, 1990 [JP] Japan ..... 2-319693

[51] Int. Cl.[5] ..... F02M 13/06

[52] U.S. Cl. ..... 123/196 R; 184/6.5

[58] Field of Search ..... 123/73 AD, 196 R; 184/6.5

[56] References Cited

U.S. PATENT DOCUMENTS

| | | | |
|---|---|---|---|
| 3,447,519 | 6/1969 | Marcik et al. | 123/73 AD |
| 3,545,417 | 12/1970 | Yamamoto | 123/73 AD |
| 3,868,929 | 3/1975 | Ishikawa | 123/73 AD |
| 3,908,612 | 9/1975 | Lamm | 123/73 AD |
| 4,414,929 | 11/1983 | Sakurai | 123/73 AD |
| 4,615,305 | 10/1986 | Matsumoto | 123/73 AD |
| 4,632,085 | 12/1986 | Misawa et al. | 123/73 AD |
| 5,020,484 | 6/1991 | Ishikawa et al. | 123/73 AD |

*Primary Examiner*—David A. Okonsky
*Attorney, Agent, or Firm*—Bacon & Thomas

[57] ABSTRACT

A lubricating system for use in a two-cycle engine having at least one valve pivotally mounted through bearings in the sidewall of an intake passage of a carburetor is disclosed which supplies lubricating oil directly on the sidewall of the intake passage to lubricate the valve bearings in order to prevent corrosion and sticking of the valve. The lubricating oil is delivered into the intake passage directly on the sidewalls upstream of the bearings so that the lubricating oil flows along these walls to assure adequate flow to the bearings. The lubricating oil may be delivered into the intake passage by supplying the oil directly through at least one of the bearings of the valve.

18 Claims, 4 Drawing Sheets

TWO-CYCLE ENGINE WITH SEPARATE LUBRICATING SYSTEM

BACKGROUND OF THE INVENTION

1. Field of the Invention

This invention pertains to a two-cycle marine engine equipped with a separate, lubricating system. The lubricating system is designed to assure that air/charge flow control valves and their associated bearings in the engine carburetor are adequately lubricated and protected from corrosion.

2. Discussion of the Prior Art

When used in salt water environments, marine engines are subjected to the corrosion effects of salt. One particular corrosion problem occurs when the salt enters the air intake of the carburetor and adheres to the rotating choke plate valve or the throttle plate valve of the carburetor or their respective bearings. This corrosion effect can occur even when the engine is not running.

A previously proposed solution to this problem of preventing salt from adhering to and corroding carburetor valves is disclosed in Japanese Patent Publication No. Sho 64-32010. This solution involved locating lubrication oil injector openings upstream of the throttle or choke valves in the air intake passage of the carburetor. The injected oil functioned to lubricate the throttle or choke valve and to prevent salt adhesion to these valves. In this prior disclosure the lubricant oil would be joined with the fuel and air charge entering the combustion chambers of the engine and would additionally lubricate the crankshaft bearings and pistons.

This previous proposal was found to provide excellent results in preventing salt adhesion to air/charge flow control valves when compared with other prior art lubricating arrangements which are located in the oil injectors downstream of the carburetor. However, since the injectors were located in the center of the air intake passage, there were cases when a sufficient amount of oil would not reaching the bearings on either side of the throttle or choke plate valves, particularly when only small amounts of oil were being injected such as when the engine was running at low speeds. Therefore, if an engine with such a lubrication system operated for long periods of time at low speeds and then was turned off without first revving it up to a higher speed, salt deposits would accumulate on the valves and their associated bearing, causing eventual corrosion and sticking of the valves.

An additional problem exists in small marine crafts, such as jet skis, since these crafts generally tip onto their sides during operation thereby causing sea water to enter the engine compartment. The salt in the sea water entering the engine compartment could adhere to air/-charge control valves of the engine and cause sticking. When sticking of the throttle valve occurs, it can be difficult to control engine acceleration and deceleration; when salt adheres to the choke valve, cold starting becomes a problem.

SUMMARY OF THE INVENTION

The objective of this invention is to provide a two-cycle engine having a separate lubricating system which makes stable engine operation possible at all times by preventing salt adhesion to the throttle and choke valves of the engine.

In order to resolve the above mentioned problems the present invention discloses a separate lubricating type two-cycle engine having an oil pump for supplying lubricating oil from an oil tank to oil injectors located adjacent the air intake passage on the upstream side of the bearings associated with the throttle and choke valves of the carburetor. In one embodiment, the injection of the lubricating oil from the oil tank is actually made via the bearings of the above mentioned valves so that the oil enters the air intake passage from the side of the bearings facing the passage.

By the present arrangement, the lubricating oil from the oil injector openings, located in the side walls of the air intake passage, will be forced downstream of the injectors by the flow of air through the intake passage over the throttle and choke valves of the carburetor along with their associated bearings. Alternatively, the lubricating oil can be supplied directly to both bearings of the valve(s) to assure a constant supply of oil to these bearings.

DETAILED DESCRIPTION OF THE PREFERRED EMBODIMENTS OF THE INVENTION

Figure 1:
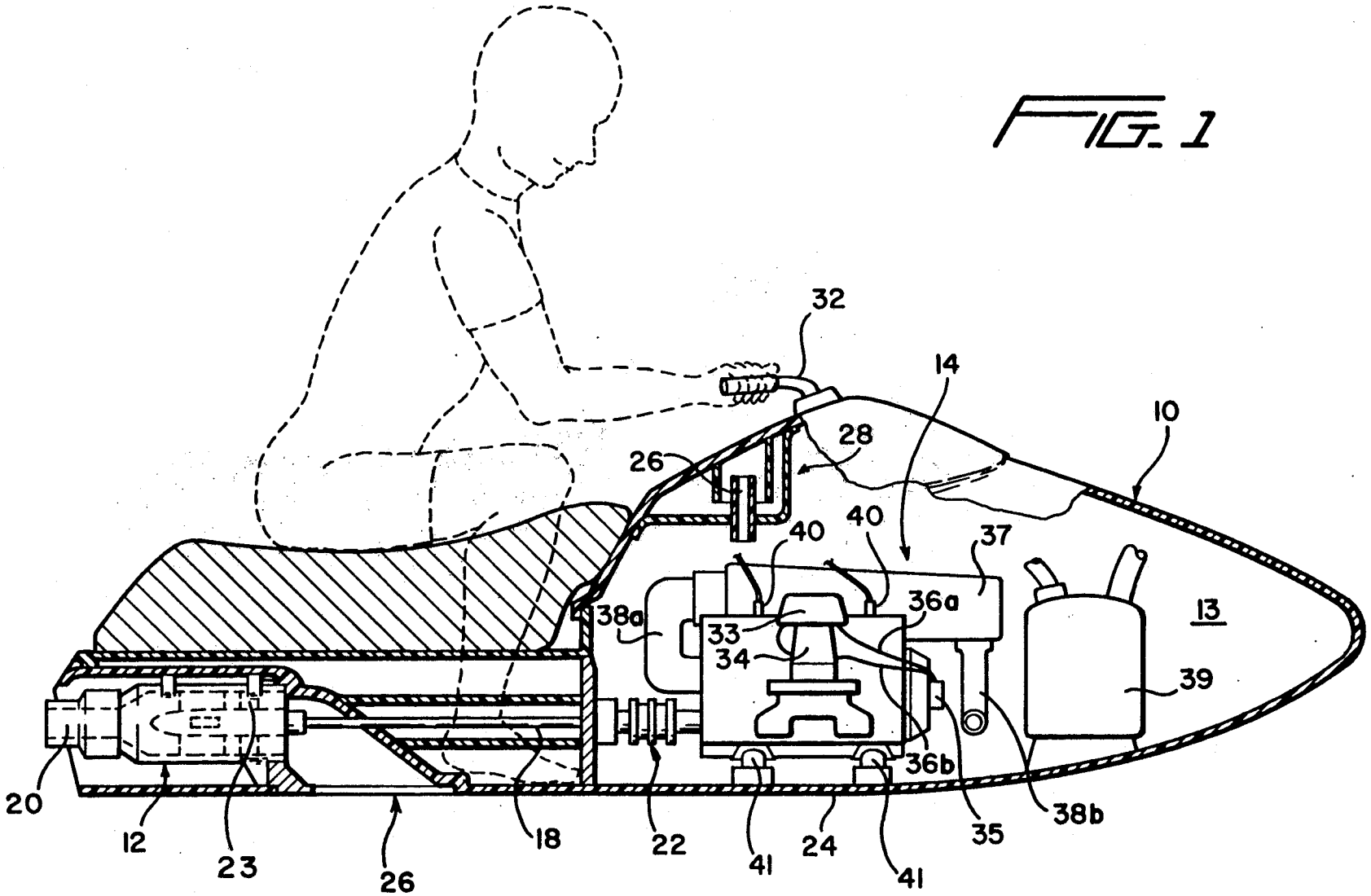
FIG. 1 shows a cross-sectional side view of a watercraft incorporating a two-cycle engine with a separate lubricating system according to this invention.

FIG. 1 generally depicts a jet ski type watercraft 10 in cross-section which includes a jet propulsion unit 12 which is driven by an engine 14 enclosed within an engine compartment 13. Jet propulsion unit 12 is located aft of the engine compartment 13 which, in turn, is located forward of the center of watercraft 10. Jet propulsion unit 12 includes an impeller 16, a propeller shaft 18 and a rudder nozzle 20. Propeller shaft 18 is driven by engine 14 through coupling 22 which is adapted to minimize the transmittal of torsional vibrations developed during operation of engine 14 to propeller shaft 18. Impeller 16 is secured to an end of propeller shaft 18 and directly driven thereby. During operation of watercraft 10, as is known in the art, water enters intake 23 located in bottom 24 of watercraft 10 and is ejected rearward through rudder nozzle 20 by means of impeller 16.

An air intake 26 vents engine compartment 13 to the atmosphere via air-water separator 28. Air intake 26 is connected, via an air intake silencer 33, with carburetor 34 of engine 14.

Operation of engine 14 not only functions to drive propeller shaft 18, but also drives a lubricating oil pump 35 having oil output supply lines **36*a* and 36*b*. Also depicted in FIG. 1** and located in engine compartment 13 is an exhaust system including an exhaust expansion chamber 37 and exhaust pipes 38*a* and 38*b*; a fuel tank 39 for engine 14; spark plugs 40; and an anti-vibrational engine mount 41.

Figure 2:
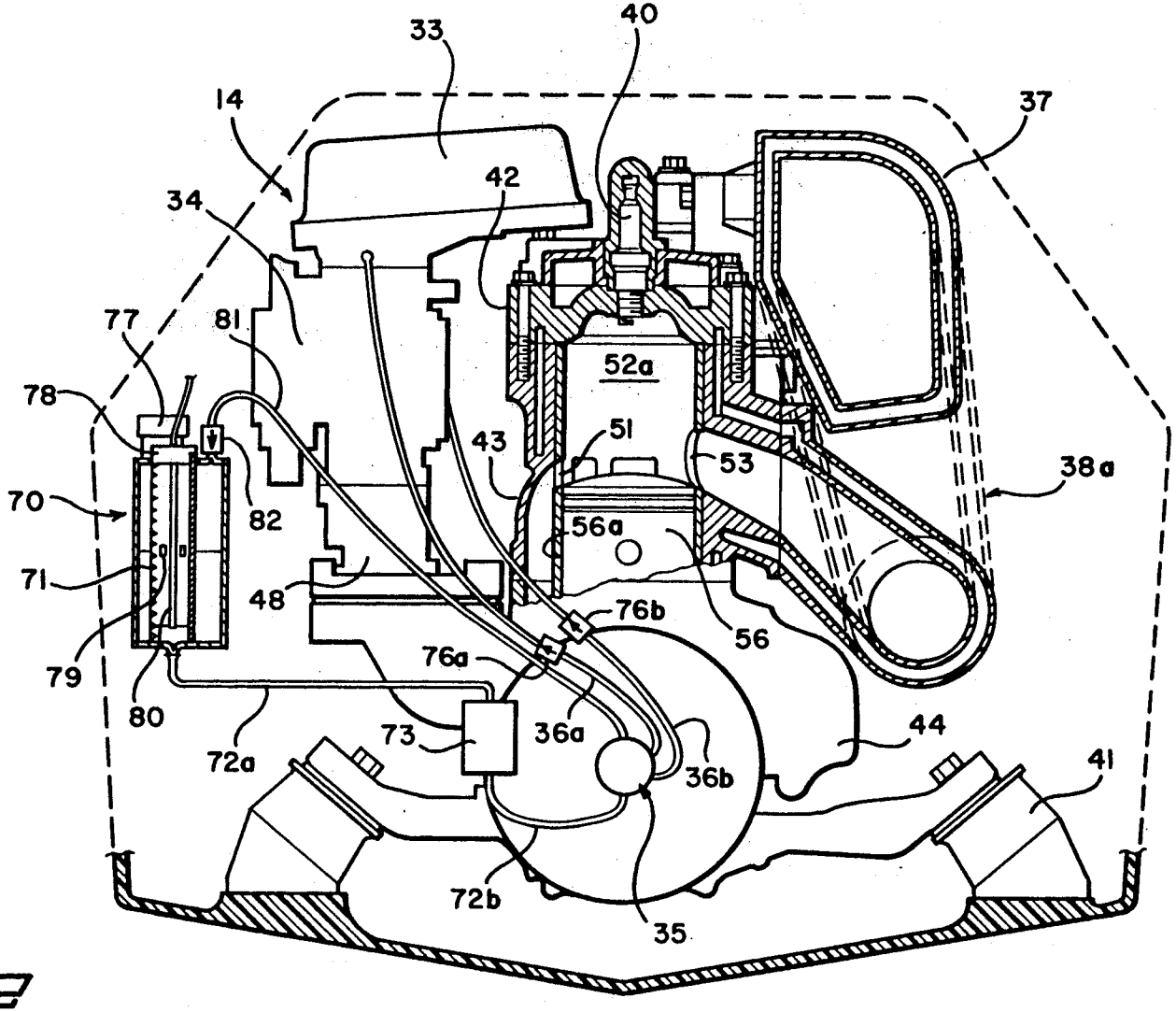
FIG. 2 shows a front cross-sectional view of the two-cycle engine and lubrication system shown in FIG. 1.
Figure 3:
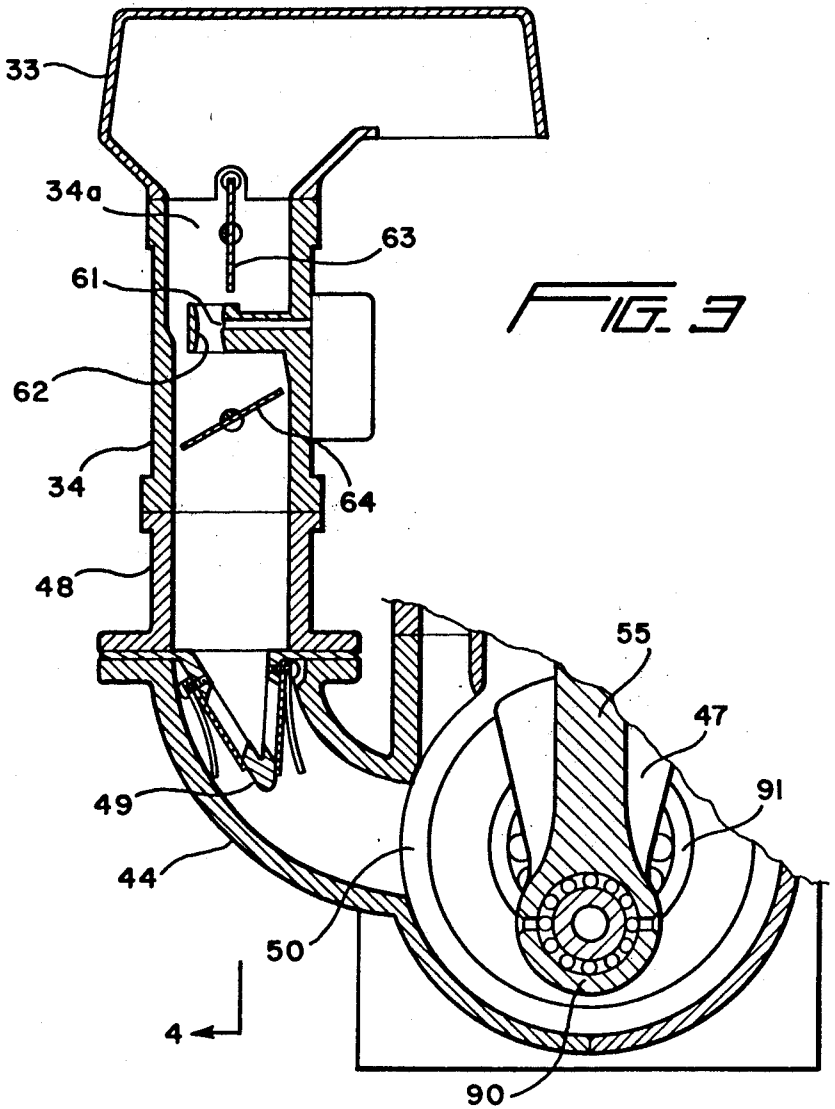
FIG. 3 shows a cross-sectional view of the air intake device according to a first embodiment of the invention.

With reference to FIGS. 2 and 3, engine 14 comprises a cylinder head 42, a cylinder block 43 and crankcase 44. During operation of engine 14, fresh air is supplied from intake silencer 33 to carburetor 34 where it is mixed with fuel to form a charge. The charge passes through intake manifold 48 and flapper valve 49 and enters crankcase 50. From crankcase 50 the charge enters a cylinder 52*a* of engine 14 through a scavenging port 51. After ignition and combustion/expansion, the exhaust combustion products are forced through port 53, through exhaust pipe 38*a*, exhaust expansion chamber 36, and out to atmosphere through exhaust pipe 38*b*. Of course, the energy developed during the combustion/expansion process acts on a reciprocating piston 56 located within cylinder 52*a* which, in turn, causes a connecting rod 55 to drive output crankshaft 47 of engine 14.

Figure 4:
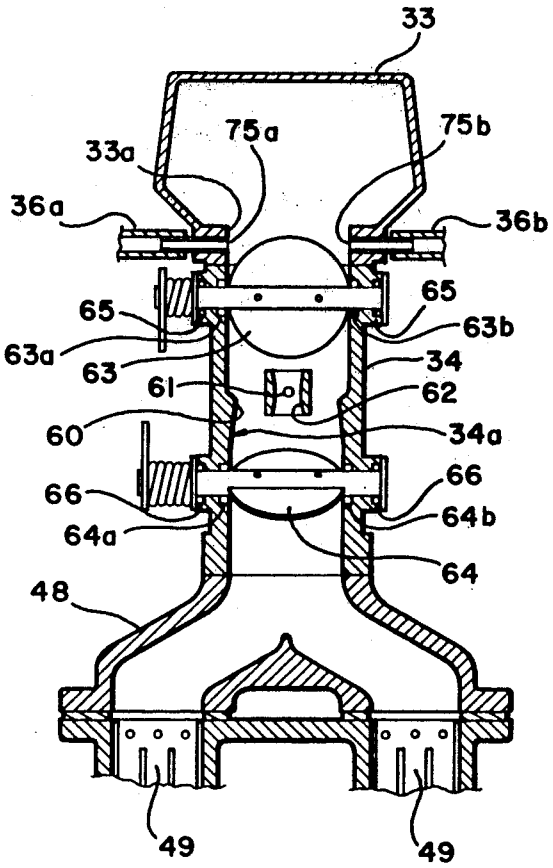
FIG. 4 is a cross-section taken along line IV—IV of FIG. 3.

Reference will now be made to FIGS. 3 and 4 which more clearly depict the carburetor 34 of the present invention. As previously stated, air intake silencer 33 opens into carburetor 34 and, more particularly, into a longitudinally extending air intake passage 34*a* of carburetor 34. Located within air intake passage 34*a* is a venturi passage 62 into which a fuel outlet port 61 projects. Venturi 62 is located downstream of a choke valve 63 and upstream of a throttle valve 64, both of which are herein referred to as air/charge flow control valves and are associated with carburetor 34. As best shown in FIG. 4, choke valve 63 is rotatably mounted within carburetor 34 by means of bearings 63*a* and 63*b* located on either side of choke valve 63. Bearings 63*a* and 63*b* have associated oil seals 65 to seal bearings 63*a* and 63*b* from engine compartment 13. In a similar manner, throttle valve 64 is mounted within carburetor 14 through bearing 64*a* and 64*b* and includes associated oil seals 66. In the preferred embodiments, oil seals 65 and 66 take the form of O-rings and prevent lubricating oil from leaking out of carburetor 34 into engine compartment 13.

Further mounted within engine compartment 13 is a lubricating oil tank 70. As previously stated, lubricating oil pump 35 is driven by the output of engine 14. Lubricating oil pump 35 draws lubricating oil from lubricating oil tank 70 through a filter 71, a lubricating oil line 72*a*, an air infiltration eliminator 73, and a lubricating line 72*b* as best shown in FIG. 2. The output from lubricating oil pump 35 flows through oil supply lines 36*a*, 36*b* and enters carburetor 34 through outlet ports 75*a* and 75*b* located at the side walls of intake passage 34*a* upstream from and along imaginary longitudinally extending lines through bearings 63*a* and 63*b* respectively and adjacent the connection location of air intake silencer 33 to carburetor 34 as best depicted in FIG. 4. In general, the oil flow through supply lines 36*a* and 36*b* are controlled to increase with increases in engine RPM and load. Located within oil supply lines 36*a* and 36*b* are check valves 76*a* and 76*b* respectively which prevent the reverse flow of lubricating oil within oil supply lines 36*a* and 36*b*.

Again referencing FIG. 2, lubricating oil tank 70 includes a cap 77 which can be removed to permit the refilling of oil tank 70. An oil level detector 78 may be associated with lubricating oil tank 70 to provide an indication of when tank 70 needs to be refilled. In the preferred embodiment, oil level detector 78 comprises a float 79 having a magnet attached thereto which causes a warning signal to be emitted, through lead line 80, to an oil level indicator (not shown) visible to an operator of watercraft 10 when the oil level within lubricating oil tank 70 is low. Lubricating oil pump 35 includes an air return line 81 which functions to return any air to lubricating oil tank 70 passing through air infiltration eliminator 73 which may occur when the watercraft 10 tips over during operation. A check valve 82 is located at the interconnection of air return line 81 to lubricating oil tank 70 to assure one directional flow within air return line 81.

With reference to FIGS. 3 and 4, lubricating oil is fed into air intake passage 34*a* directly in contact with the sidewall of the passage through oil injection outlets 75*a* and 75*b*, flows along the inner wall 60 of carburetor 34, across the bearings 63*a*, 63*b* of choke valve 63, over the inside surface of venturi to 62, over bearings 64*a*, 64*b* of throttle valve 64 and is then drawn down into crankcase 50 with air admitted through air intake passage 34*a*. Within crankcase 50, the lubricating oil coats bearings 90 associated with a connecting rod of 47, crankshaft bearings 91, and the lower walls of cylinder 52*a* within which piston 56 reciprocates. The lubricating oil then enters the combustion chamber of cylinder 52*a* through scavenging port 51 where it is consumed in the combustion process.

By the above described lubricating system, lubrication of the various shaft bearings 63*a*, 63*b*, 64*a* and 64*b* are assured. Since lubricating oil enters intake passage 33*a* at its side walls and is continually fed during operation of engine 14 along the inner walls of intake passage 34*a* to bearings 63*a*, 63*b*, 64*a* and 64*b*, salt is prevented from adhering to these bearing surfaces and constricting the operation of choke valve 63 and throttle valve 64 respectively.

Figure 5:
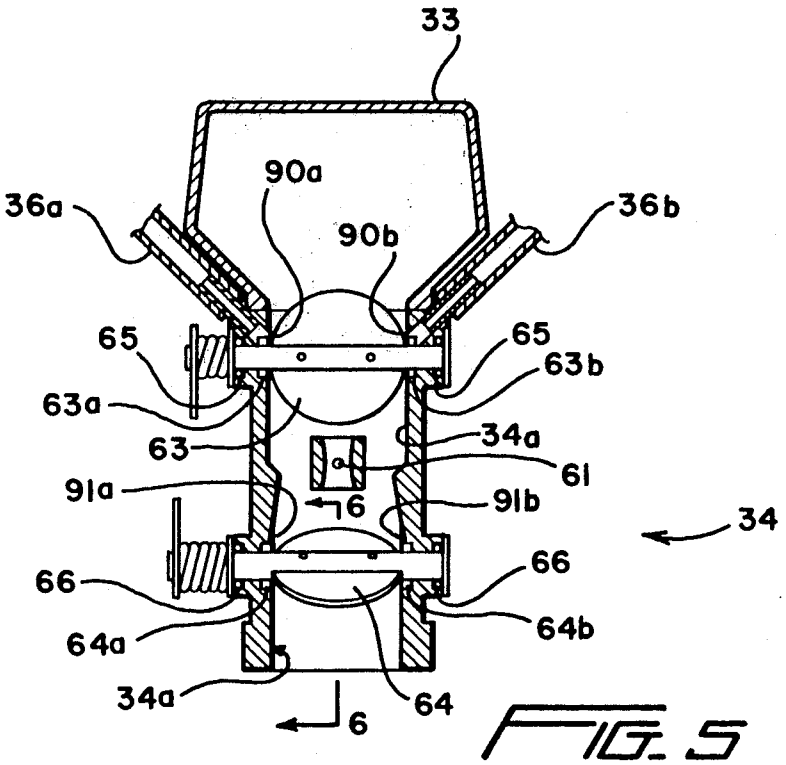
FIG. 5 depicts a cross-sectional view of an air intake and lubrication arrangement according to a second embodiment of the invention.
Figure 6:
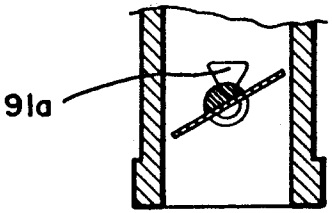
FIG. 6 is a cross-sectional view taken along line VI—VI of FIG. 5.

Reference will now be made to FIGS. 5 and 6 which depict cross-sectional views of an air intake and lubrication arrangement according to a second embodiment of the invention. In this embodiment, oil supply lines 36*a* and 36*b* open into carburetor 34 through bearings 63*a* and 63*b* of choke valve 63. In order for the lubricating oil to flow into air intake passages 34*a* of carburetor 34, openings 90*a* and 90*b* are respectively formed on the air intake passage side of bearings 63*a* and 63*b*. Again, oil seals 65 prevent the lubricating oil from leaking out of carburetor 34. Since the lubricating oil in this embodiment is directly supplied to bearings 63*a* and 63*b*, this arrangement additionally assures a supply of lubricating oil to the bearings 63*a* and 63*b* to prevent their corrosion by ingressed salt. In this embodiment, bearings 64*a* and 64*b* associated with throttle valve 64 are lubricated in a manner directly analogous to that described in the first embodiment. FIGS. 5 and 6 depict one alteration with regard to the lubrication of bearings 64*a* and 64*b* in that respective depressions 91*a* and 91*b* are formed within air intake passages 34*a* just upstream of throttle valve 64. Depressions 91*a* and 91*b* function to guide lubricating oil to bearing 64*a* and 64*b* and also serve as a reservoir recess for the oil.

Figure 7:
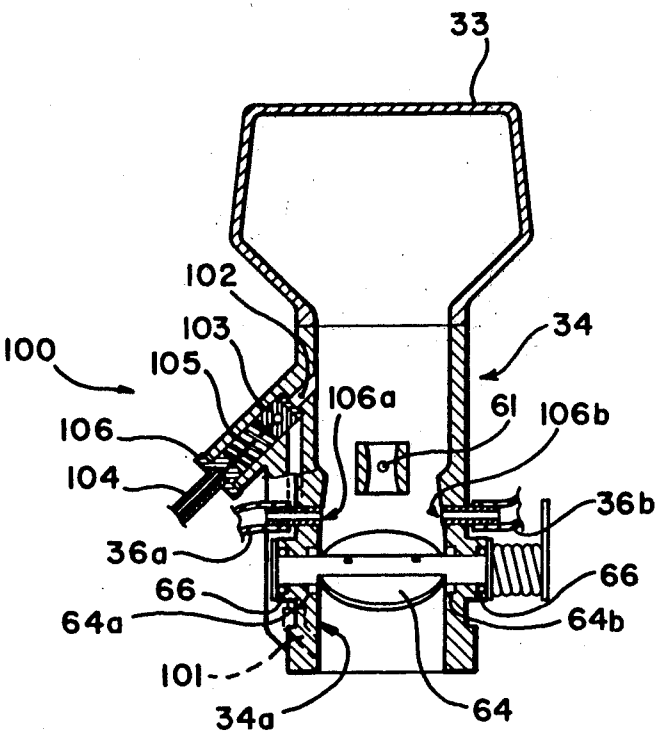
FIG. 7 depicts a third embodiment of the arrangement of the present invention in a cross-section.

FIG. 7 depicts a third embodiment of an air intake and lubrication arrangement according to the present invention which can be used with a carburetor 34 that does not have a choke valve. In such an arrangement, when engine 14 is started, the throttle valve 64 is completely closed and bypassed such that a concentrated air/fuel mixture is sent to a starting carburetor 100.

Starting carburetor 100 is incorporated as a unit within carburetor 34 and is comprised of an air intake passage 101 located upstream of throttle valve 64, a starting fuel nozzle 102 which opens into the air intake passage 101 and a starter valve 103 which functions to open and close air intake passage 101. A wire 104 is connected to starter valve 103 and extends to a position adjacent an operator of watercraft 10 so it can be manually manipulated by the operator. Starting carburetor 100 further includes a spring 105 which biases starter valve 103 into a closed position and an end cap 106.

When using a carburetor as that depicted in FIG. 7 and described above, the lubricating oil from oil supply lines 36*a* and 36*b* flows along the sidewall of air intake passage 34*a* of carburetor 34 upstream of throttle valve 64 and downstream of starting carburetor 100. By this arrangement, bearings 64*a* and 64*b* of throttle valve 64 would be lubricated in a manner directly analogous to that described with respect to the FIG. 1 embodiment. In addition, it is possible to provide the use of reservoir depressions analogous to depressions 91*a* and 91*b* described with reference to the embodiment of FIGS. 5 and 6 or to have lubricating oil supply lines 36*a* and 36*b* open into bearings 64*a* and 64*b* respectively in a manner analogous to that described with respect to the second embodiment above. In an event, the lubricating system assures constant and adequate lubrication of the valves associated with carburetor 34 to prevent salt from adhering to these valves and thereby prevents corrosion and sticking of the valves. It should be noted that the lubricating system of the present invention prevents the valves of carburetor 34 from sticking even when engine 14 is run for long periods at low speeds and when the engine is stopped without revving to high speeds.

It should be noted that various changes and/or modifications may be made to the invention as described above without departing from the spirit of the invention as encompassed in the following claims.

I claim:

1. A lubricating system for a two-cycle engine having a carburetor including at least one air/charge flow control valve rotatably mounted through at least one bearing arranged within at least one sidewall of a longitudinally extending air/charge intake passage of the carburetor, comprising:

an oil tank;

an oil pump;

means for actuating the oil pump;

supply line means connecting said oil tank and said oil pump;

output line means extending from said oil pump, terminating in said sidewall and opening into said intake passage upstream from and along an imaginary longitudinal line extending through said at least one bearing.

2. A lubricating system as claimed in claim 1, wherein said oil pump is actuated by the engine.

3. A lubricating system as claimed in claim 1, wherein said air/charge flow control valve includes first and second end portions rotatably mounted within said air/charge intake passage by respective bearings and said output line means terminates in first and second lubricating oil injection openings located in the sidewall of the intake passage upstream of and along imaginary longitudinal lines extending through each of said first and second end portions respectively.

4. A lubricating system as claimed in claim 1, wherein said at least one valve and said at least one bearing includes a choke plate valve pivotally mounted therein through first bearings and a throttle plate valve pivotally mounted therein through second bearings, said first and second bearings being located in said sidewall, and wherein said output line means communicates with said intake passage through at least one of said first and second bearings.

5. A lubricating system as claimed in claim 4, wherein said throttle valve is located downstream of said choke valve and said output line means communicates with said intake passage through said first bearings.

6. A lubricating system as claimed in claim 1, wherein said at least one bearing extends through the sidewall of the intake passage, and including seal means for preventing flow of oil outwardly of the intake passage through said bearing.

7. A lubricating system as claimed in claim 1, including a reservoir recess in said sidewall where said sidewall intersects said bearing.

8. A lubricating system for a two-cycle engine having a carburetor including at least one air/charge flow control valve rotatably mounted through at least one bearing arranged within at least one sidewall of a longitudinally extending air/charge intake passage of the carburetor, comprising:

means for supplying liquid lubricant directly to said at least one sidewall upstream from and along an imaginary longitudinal line extending through said at least one bearing.

9. A lubricating system as claimed in claim 8, wherein said means for supplying lubricant includes means for positively supplying said lubricant to said sidewall while the engine is operating.

10. A lubricating system as claimed in claim 8, wherein said means for supplying lubricant includes an engine driven oil pump, a lubricant reservoir, and conduits for transporting lubricant from the reservoir to the pump and from the pump to said sidewall.

11. A lubricating system as claimed in claim 8, wherein said at least one air/charge flow control valve includes both a choke plate and a throttle plate supported by respective choke plate and throttle plate bearings in the sidewall of said air/charge passage, and said means for supplying lubricant includes means for supplying lubricant to the air/charge passage upstream of both said choke plate and throttle plate bearings.

12. A lubricating system as claimed in claim 8, including a reservoir recess in said sidewall at the intersection of said sidewall and said bearing.

13. A lubricating system as claimed in claim 8, wherein said at least one bearing extends through said at least one sidewall, and including means for sealing said bearing against flow of lubricant out of the air/charge passage through said bearing.

14. A method of lubricating a carburetor throttle plate valve bearing associated with a longitudinally extending air/charge passage of a carburetor of a two-cycle engine comprising supplying lubricating oil directly to the upper sidewall area of the carburetor air/charge passage at a point upstream of the throttle plate valve and along an imaginary longitudinal line extending through the bearing during engine operation and causing the oil to flow along the sidewall across the bearing and into the charge supply port of the engine.

15. A method according to claim 14, wherein the air/charge passage includes a choke plate valve mounted in a bearing disposed in the air/charge passage sidewall, including lubricating the choke plate bearing by supply lubricating oil directly to the upper sidewall area of the air/charge passage upstream of the choke plate bearing during engine operation and causing the oil to flow along the sidewall across the choke plate bearing and into the charge supply port of the engine.

16. A method according to claim 14, wherein the throttle plate bearing extends through the air/charge passage sidewall, and including sealing the throttle plate bearing against flow of lubricating oil outside the air/-charge passage through the throttle plate bearing.

17. A method according to claim 15, wherein the choke plate bearing extends through the air/charge passage sidewall, and including sealing the choke plate bearing against flow of lubricating oil outside the air/-charge passage through the choke plate bearing.

18. A method according to claim 14, wherein the carburetor includes a choke plate valve mounted in at least one choke plate bearing extending through the sidewall of the air/charge passage, said choke plate located upstream of said throttle plate, including supplying said lubricating oil directly to the upper sidewall of the carburetor air/charge passage by supplying said oil through the choke plate bearing. a

* * * * *